United States Patent [19]

Maltby et al.

[11] Patent Number: 4,759,258

[45] Date of Patent: Jul. 26, 1988

[54] FLUID POWERED ACTUATOR SYSTEM

[75] Inventors: Peter J. Maltby, Codsall; Stanley G. Glaze, Brierley Hill; Terence J. Capewell, Wheaton Aston; Philip Clarke, Penn, all of England

[73] Assignee: Lucas Industries, P.L.C., England

[21] Appl. No.: 763,235

[22] Filed: Aug. 7, 1985

[30] Foreign Application Priority Data

Aug. 11, 1984 [GB] United Kingdom ..... 8420488

[51] Int. Cl.[4] ..... F01L 15/00

[52] U.S. Cl. ..... 91/171; 91/189 R; 91/387; 91/513; 91/515; 91/521; 92/131

[58] Field of Search ..... 91/171, 515, 513, 517, 91/518, 532, 521, 189 R, 387; 92/131; 137/596

[56] References Cited

U.S. PATENT DOCUMENTS

| | | | |
|---|---|---|---|
| 3,095,784 | 7/1963 | Colhoun | 91/513 |
| 3,124,041 | 3/1964 | McMurtry | 91/513 |
| 3,401,600 | 9/1968 | Wood | 91/513 |
| 3,402,553 | 9/1968 | Mercier | 92/131 |
| 3,765,306 | 10/1973 | Luft | 92/131 |
| 3,850,081 | 11/1974 | Joelson | 91/171 |
| 4,231,284 | 11/1980 | Smith | 91/171 |
| 4,397,222 | 8/1983 | Glaze | 91/515 |
| 4,484,637 | 11/1984 | Mayer | 91/171 |
| 4,585,024 | 4/1986 | Esseniyi | 92/131 |

FOREIGN PATENT DOCUMENTS

| | | |
|---|---|---|
| 1020860 | 2/1953 | France . |
| 937487 | 9/1963 | United Kingdom . |
| 1341290 | 12/1973 | United Kingdom . |
| 2103388 | 2/1983 | United Kingdom . |

*Primary Examiner*—Abraham Hershkovitz
*Attorney, Agent, or Firm*—Leydig, Voit & Mayer

[57] ABSTRACT

A fluid powered actuator system includes two identical fluid powered actuators operable by respective supply pressures which are controlled by respective identical valve arrangements. Operating positions of flow control elements of the valve arrangements are applied through respective couplings to a differential arrangement which operates, if these positions differ by an unacceptable amount, to apply an error indication through respective coupling to prevent the supply pressures from being applied to the respective actuators.

6 Claims, 4 Drawing Sheets

FLUID POWERED ACTUATOR SYSTEM

This invention relates to a fluid powered actuator system, and in particular to such a system which includes duplicated actuators coupled to provide a combined output, and duplicated control valves for the respective actuators.

In such a system it is desirable that the flow control elements should move by equal amounts. It is known to provide for comparison between the positions of input operating devices for the two valves, but such prior art systems do not monitor the positions of the value control elements themselves.

It is an object of the invention to provide a system having duplicated fluid powered actuators and control valves, in which operating positions of control elements of the valves are sensed directly, and in which an unacceptable difference between these operating positions results in removal of a fluid pressure supply to the valves.

It is a further object of the invention to provide that input devices for the control valves are operated in accordance with a difference between desired and sensed positions of an actuator device to which fluid is supplied by the valves.

According to the invention there is provided a fluid powered actuator system comprising two fluid powered actuators which are coupled to provide a combined output, two valve devices operable to apply fluid pressures to respective ones of said actuators, a first differential arrangement responsive to operating positions of both of said valves for providing an error output when said positions differ by more than a predetermined amount, and valve means for removing a pressure supply from said valve devices in response to said error output.

An embodiment of the invention will now be described by way of example only and with reference to the accompanying drawings in which.

Figure 1:
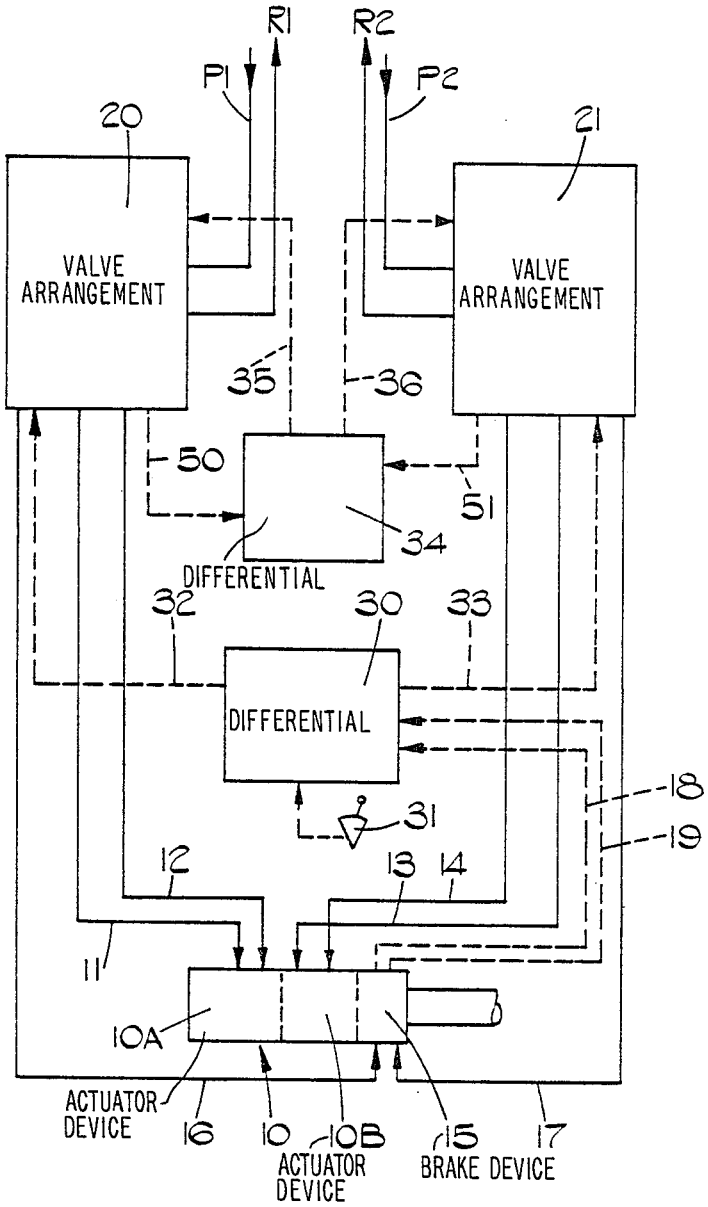
FIG. 1 is a block diagram of the actuator system.

As shown in FIG. 1 the system comprises a double acting fluid powered actuator 10 which effectively comprises two actuator devices 10A, 10B coupled for movement in unison and responsive to pressure signals on respective pairs of control lines 11, 12 and 13, 14. The actuator 10 includes a brake device 15 which can be maintained inoperative by pressures on lines 16 and 17. The actuator 10 also includes means for providing mechanical position feedback signals on two shafts indicated at 18 and 19, and shown more clearly in FIG. 3. The system also includes two identical valve arrangements 20, 21, the arrangement 20 being shown in more detail in FIG. 2. The arrangements 20, 21 are connected to separate fluid pressure supply lines P1, P2 and separate return lines R1, R2 and are operative to control the pressures on lines 11, 12 and lines 13, 14 respectively.

Figure 4:
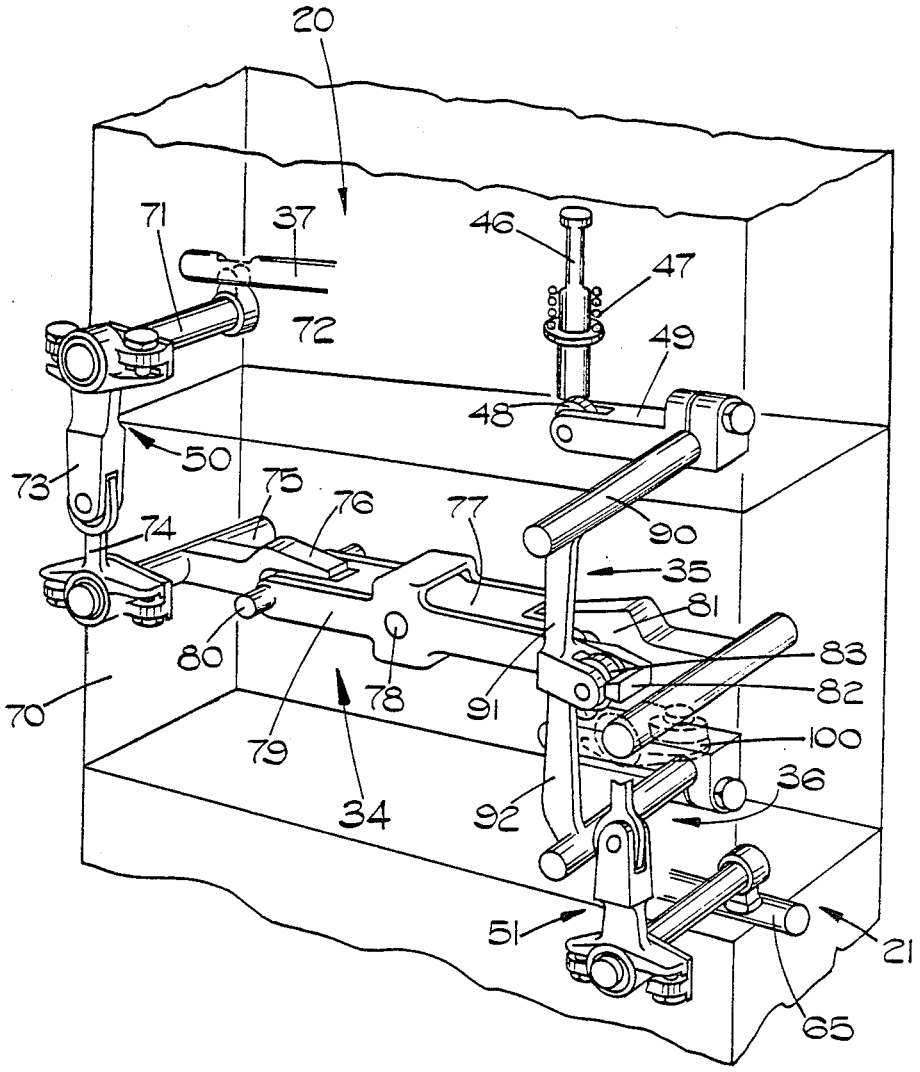
FIG. 4 is a pictorial view on arrow 4 in FIG. 3 of a differential device responsive to the positions of the valves, for operating bypass valves as shown in FIG. 2.

A first differential arrangement 34 is shown more clearly in FIG. 4 and is responsive to a discrepancy between the operating positions of valves 22 in the arrangements 20, 21 to isolate these valves 22 from the respective pressures P1, P2, by means of respective linkages 35, 36.

Figure 3:
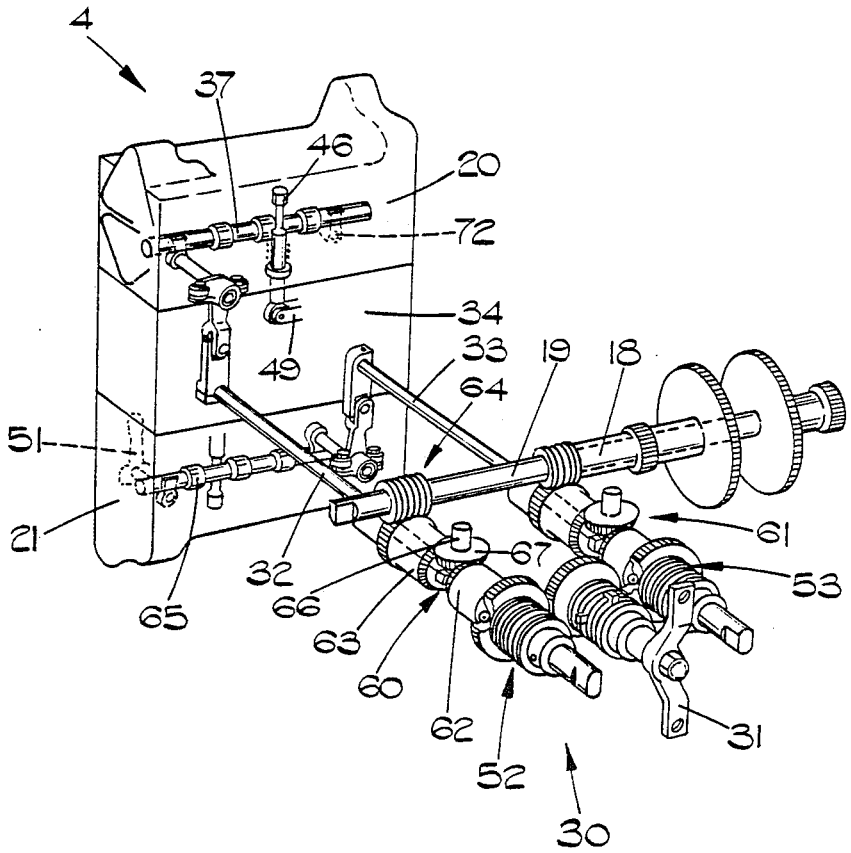
FIG. 3 shows pictorially the mounting of the valve arrangements of FIG. 1 and a differential system for positioning the valves.

A second differential arrangement 30, shown in more detail in FIG. 3 is responsive to an input movement from an actuator position selector 31 and to the rotational positions of the shafts 18, 19 to provide mechanical outputs on shafts 32, 33 to the respective valve arrangements 20, 21, as shown more clearly in FIG. 3.

Figure 2:
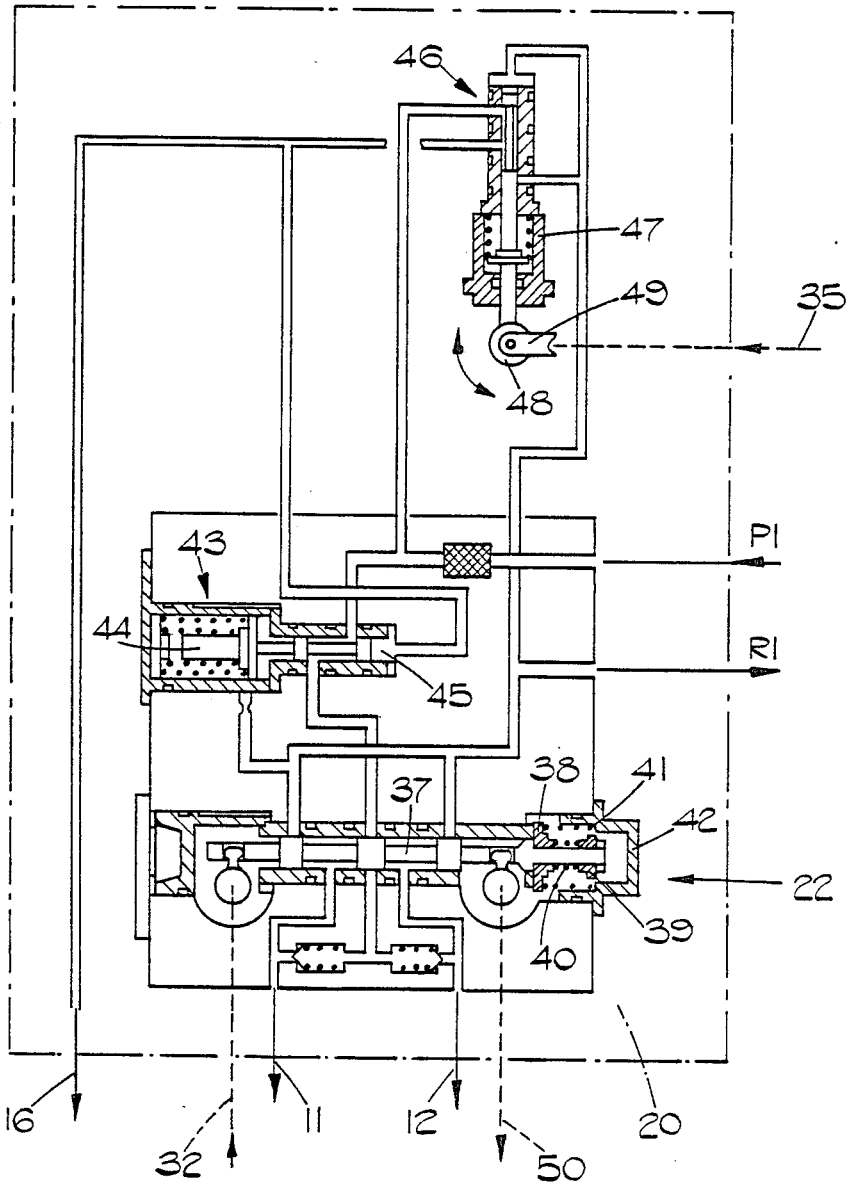
FIG. 2 is a diagram of one of the valve arrangements forming part of FIG. 1.

As shown in FIG. 2 the valve 22 in the arrangement 20 includes a valve spool 37 linearly movable by the shaft 32 to connect the lines 11, 12 selectively to the supply pressure P1 or return pressure R1. The spool 37 has a sliding collar 38 and a further collar 39 which abuts a fixed part of the spool. A compression spring 40 acts between the collars 38, 39 and a further compression spring 41 acts between the collar 38 and a relatively fixed part 42. The arrangement is such as to bias the spool 37 to a central position (shown) in which the lines 11, 12 are isolated from the supply and return pressures. The supply pressure P1 is applied to the valve spool 37 by way of a shut-off valve 43 having a spool 44 spring-biased towards a shut position. The spool 44 can be urged to its open position (shown) by the pressure in a chamber 45 derived from the pressure P1 through a normally shut bypass valve 46. The bypass valve 46 is urged towards to an open position by a spring 47 but is normally restrained against opening movement by a roller 48 on a pivotally mounted arm 49 which is shown in more detail in FIG. 4 and which forms part of the linkage 35. The operating position of the spool 37 is transmitted through a linkage 50, also shown in more detail in FIG. 4 to the differential device 34.

It is to be understood that the valve arrangement 21 corresponds to the arrangement 20 described above and is responsive to position signals on the shaft 33 and provides valve position signals through a linkage 51 to the differential device 34.

As shown in FIG. 3 the differential device 30 comprises two identical gear trains 60, 61, only the train 60 being described in detail. The train 60 includes a bevel gear 62 drivingly coupled to the position selector 31 and an opposed bevel gear 63 drivingly connected through a worm and wheel 64 to the feedback shaft 19 from the actuator 10. A third bevel gear 67 meshes with the gears 62, 63 and is mounted for free rotation on a stub shaft 66 secured to the actuating shaft 32 for the valve spool 37, the shaft 32 passing axially through the bevel gears 62, 63. The arrangement is such that rotation of the bevel gear 62 results in rotation of the shaft 32 in the same direction, and consequent movement of the spool 37. Subsequent movement of the actuator 10 causes rotation of the bevel gear 63 in the opposite direction to that of the gear 62 and thus returns the shaft 32 and spool 37 to its initial position. It will be seen that in normal operation movements of the spool 37 and of the corresponding spool 65 in the valve arrangement 21 will be identical. The differential device 34 operates in a manner to be described to isolate the spools 37, 65 from their respective supply pressures P1, P2 in the event that the spool movements differ significantly. Drive to the gear trains 60, 61 from the position selector 31 is by way of respective friction clutches 52, 53, so malfunction of either of the spools 37, 65 or of the input couplings thereto does not adversely affect other parts of the system.

As shown in FIGS. 3 and 4 the valve arrangements 20, 21 and the differential device 34 are mounted in a housing block 70 which is indicated in outline only in FIG. 4. As shown in FIG. 4 the linkage 50 includes a shaft 71 pivotally mounted in the housing 70 and having a projection 72 engaging a recess in the valve spool 37. A lever arm 73 on the shaft 71 engages a further lever arm 74 on a further shaft 75 also pivotally mounted in the housing block 70. A forked lever 76 engages one end of an arm 77 which is mounted for movement about a pivot 78 in a bracket 79. The bracket 79 is itself mounted for movement about a pivot 80 supported in the housing block 70. The other end of the arm 77 is engaged by a forked lever 81 which corresponds to the lever 76 and forms part of the linkage 51 which co-acts with the valve spool 65. In normal operation the spools 37, 65 move by equal amounts in opposite directions so that movements of the forked levers 76, 81 are equal, and the arm 77 moves about the pivot 78, but the bracket 79 does not itself move about the pivot 80. However, difference in movement between the spools 37 and 65 causes pivotal movement of the bracket 79 and this bracket has a cranked end 82 which engages a roller 83 forming part of the linkage 35.

In addition to the lever 49 and roller 48 the linkage 35 includes a shaft 90 which is pivotally mounted in the housing block 70 and on which the lever 49 is supported. The shaft 90 has a crank arm 91 on which the roller 83 is carried and the roller 83 is biassed against the cranked end of the bracket 79 by the spring 47 acting on the bypass valve 46. The arrangement is such that pivotal movement of the bracket 79 by more than a predetermined amount allows the crank arm 91 and the lever 49 to move anti-clockwise and the valve 46 to move under the influence of its spring 47 to connect the chamber 45 (FIG. 2) to the return line R1, shutting the valve 43 and isolating the spool 37 from the pressure supply P1. At the same time the pressure in line 16 falls to that of the return pressure R1 and the brake device 15 (FIG. 1) in the actuator 10 is operated.

As shown in FIG. 4 the linkage 36 is generally similar to the linkage 35, but the crank arm 92, corresponding to the arm 91, does not carry a roller but merely engages the end of the arm 91. Pivotal movement of the bracket 79 permits the arm 91 and a lever 100 to move clockwise, and a further valve (not shown), corresponding to the valve 46, to isolate the spool 65 in the arrangement 21 from the supply pressure P2 in a like manner to that described above.

As shown in FIG. 3 the drive paths between the position selector 31 and the differential gear trains 60, 61 each include a ball clutch 95 which is loaded by springs 96. This arrangement ensures that jamming of either of the trains 60, 61, or of their associated drives 32, 33, or of the spools 37, 65 results in slipping of the clutch 95 and prevents damage to the system. Differential movement of the spools 37, 65, resulting from slipping of a clutch 95 causes both spools to be isolated from their fluid pressure supplies P1, P2.

During normal operation of the system the spring loading of the valve 43 serves to maintain a pressure in the chamber 45, and therefore in the line 16, against transient pressure fluctuations which might otherwise occur as a result of operation of the valve spool 37.

Differential movement betwwen the spools 37, 65 may result from, for example, fracture of the engagement between the spool 37 and its connection to the shaft 32, in which case the springs 40, 41 (FIG. 2) will maintain the spool 37 in a central position. Alternatively if the spool 37 breaks between its connections to the shaft 32 and the linkage 50, operation of the shaft 32 to move the adjacent part of the spool 37 away from the break will cause the linkage 50 to be maintained in its central position by the spring 40, 41, resulting in shut-off of pressures P1, P2 as described above. If the shaft 32 is operated to move the adjacent part of the spool 37 against a break therein, the spool may act in a normal, or near-normal manner until an attempt is made to move it in the opposite direction.

If a connection of the shaft 32 fails, and one of the springs 40, 41 also fails, the spool 37 will be urged in one direction only by the remaining spring but the force applied by that spring will by itself be insufficient, when applied through the linkage 50, to pivot the lever 76 and thereby to result in shut-off of the pressures P1, P2. In this condition if the spool 65 (FIG. 4) is moved in a direction which corresponds to a requirement to move the spool 37 against the remaining spring 40 or 41, the spool 37 will not so move and the differential spool movement will cause pressures P1, P2 to be shut off. If, however, in this last condition of failure the spool 65 is moved in a direction which corresponds to a requirement to move the spool 37 in a direction assisted by the remaining spring, the spool 37 will be allowed to move in its proper direction as the lever 77 (FIG. 4) is permitted to turn about the pivot 78 by the forked lever 81. In this last operating condition the spool 37 will act normally or near-normally.

The arrangement of the present invention thus provides either for shut-down or for continued near-normal operation under all mechanical malfunctions of the valves 22 or the input drives thereto.

We claim:

1. A fluid power actuator system comprising two fluid-powered actuators coupled to provide a combined output, two valve devices each including a spool and operable to apply fluid pressures to respective actuators, a first differential arrangement responsive to operating positions of said spools of said valve devices for providing an error output when the positions differ by more than a predetermined amount, and valve means for removing a pressure supply to said valve devices in response to the error output, each valve device further including means coacting with one end of the spool of said valve device for moving that spool to a selected position and a pair of biasing means coacting with the other end of that spool for urging that spool to a central position in which no fluid pressure is applied to the respective actuator, each of said biasing means being insufficient by itself to operate said first differential arrangement.

2. A fluid power actuator system comprising two fluid-powered actuators coupled to provide a combined output, two valve devices each including a spool and operable to apply fluid pressures to respective actuators, a first differential arrangement responsive to operating positions of said spools of said valve devices for providing an error output when the positions differ by more than a predetermined amount, and valve means for removing a pressure supply to said valve devices in response to the error output, each valve device further including means coacting with one end of the spool of said valve device for moving that spool to a selected position and a pair of biasing means coacting with the other end of that spool for urging that spool to a central position in which no fluid pressure is applied to the respective actuator, each of said biasing means being insufficient by itself to operate said first differential arrangement, said first differential arrangement comprising a first lever mounted for movement about a relatively fixed axis, a second lever mounted on said first lever for pivotal movement relative thereto, linkages coupling said spools to said second lever at locations thereon equally spaced on opposite sides of the pivotal mounting thereof on said first lever, so that equal movements of said valve spools do not result in angular movement of said pivotal mounting away from a central position relative to the fixed axis, and a further linkage coupling said first lever to said valve means.

3. An actuator system as claimed in claim 2 in which said further linkage comprises an element biased into engagement with a part of said first lever.

4. An actuator system as claimed in claim 3 including two fluid pressure supplies respectively for said control valves, and two valve means for isolating said control valves from their respective supplies.

5. An acutator system as claimed in claim 4 including a pair of further linkages coupling said first lever to respective ones of said valve means, each further linkage comprising a spring-biased arm being restrained by said part of said first lever when said pivotal mounting is in its central position.

6. An actuator system as claimed in any preceding claim further including a second differential arrangement comprising two differential devices having a first input element coupled to an actuator position selector, second input elements coupled to respective ones of said actuators, and output elements coupled to said spools of the valve devices.

* * * * *